US008104572B2

(12) United States Patent
Butler

(10) Patent No.: US 8,104,572 B2
(45) Date of Patent: Jan. 31, 2012

(54) SPIN MUFFLER

(76) Inventor: Boyd L. Butler, Sandy, UT (US)

( * ) Notice: Subject to any disclaimer, the term of this patent is extended or adjusted under 35 U.S.C. 154(b) by 2 days.

(21) Appl. No.: 12/692,543

(22) Filed: Jan. 22, 2010

(65) Prior Publication Data

US 2011/0180347 A1 Jul. 28, 2011

(51) Int. Cl.
*F01N 1/00* (2006.01)
*F01N 1/08* (2006.01)
*F01N 1/12* (2006.01)

(52) U.S. Cl. ..... 181/274; 181/264; 181/270; 181/279; 181/281

(58) Field of Classification Search ..... 181/274, 181/264, 270, 279, 281
See application file for complete search history.

(56) References Cited

U.S. PATENT DOCUMENTS

| | | | | | |
|---|---|---|---|---|---|
| 981,584 | A | * | 1/1911 | Miller | 181/253 |
| 1,002,801 | A | * | 9/1911 | Boeck | 181/264 |
| 1,474,115 | A | * | 11/1923 | Heather | 181/281 |
| 1,481,479 | A | * | 1/1924 | Murphy | 181/279 |
| 1,665,211 | A | * | 4/1928 | Kennedy | 454/221 |
| 1,695,375 | A | * | 12/1928 | Heather | 181/282 |
| 2,139,736 | A | * | 12/1938 | Durham | 181/274 |
| 2,906,364 | A | * | 9/1959 | Crouch et al. | 181/255 |
| 2,912,063 | A | * | 11/1959 | Barnes | 181/279 |
| 3,235,003 | A | * | 2/1966 | Smith | 165/135 |
| 3,811,531 | A | * | 5/1974 | Forssman | 181/258 |
| 4,027,740 | A | * | 6/1977 | Martin | 181/281 |
| 4,125,171 | A | * | 11/1978 | Morris | 181/265 |
| 4,185,715 | A | | 1/1980 | Reu Boiu | |
| 4,339,918 | A | * | 7/1982 | Michikawa | 60/316 |
| 4,557,349 | A | * | 12/1985 | Crump | 181/279 |
| 4,574,914 | A | * | 3/1986 | Flugger | 181/268 |
| 4,685,534 | A | * | 8/1987 | Burstein et al. | 181/251 |
| 5,152,366 | A | | 10/1992 | Reitz | |
| 5,198,625 | A | | 3/1993 | Borla | |
| 5,304,749 | A | * | 4/1994 | Crandell | 181/264 |
| 5,739,484 | A | | 4/1998 | Jones | |
| 5,756,944 | A | | 5/1998 | Battig et al. | |
| 5,773,770 | A | | 6/1998 | Jones | |
| 5,824,972 | A | * | 10/1998 | Butler | 181/279 |
| 6,089,347 | A | * | 7/2000 | Flugger | 181/264 |
| 6,364,054 | B1 | * | 4/2002 | Bubulka et al. | 181/264 |
| 6,622,821 | B2 | * | 9/2003 | Butler | 181/270 |
| 6,959,782 | B2 | | 11/2005 | Brower et al. | |
| 7,073,626 | B2 | | 7/2006 | Weinhold et al. | |
| 7,243,757 | B2 | * | 7/2007 | Stuber | 181/270 |
| 7,374,017 | B2 | * | 5/2008 | Laughlin | 181/279 |
| 7,380,639 | B2 | | 6/2008 | Arlasky | |
| 7,854,297 | B2 | * | 12/2010 | Scanlon | 181/250 |
| 2004/0065505 | A1 | * | 4/2004 | Weinhold et al. | 181/279 |
| 2006/0076185 | A1 | | 4/2006 | Arlasky | |
| 2009/0045007 | A1 | | 2/2009 | Counts | |

* cited by examiner

*Primary Examiner* — Elvin G Enad
*Assistant Examiner* — Christina Russell
(74) *Attorney, Agent, or Firm* — Thorpe North & Western LLP

(57) ABSTRACT

A muffler for attenuating acoustic noise in a gas flow which includes a casing having an inlet and an outlet, such that the gas flow passes through the casing from the inlet to the outlet. The muffler also includes an acoustic trap disposed within the casing and which spans the distance between opposing top and bottom walls of the casing. The acoustic trap further comprises a first arcuate deflector having a concave frontside surface configured to direct the gas flow from the inlet through a first segment of an expanding spiral revolution, and one or more second arcuate deflectors which are radially offset from the first arcuate deflector and configured to direct a portion of the inlet gas flow through a remainder segment of the expanding spiral revolution.

25 Claims, 8 Drawing Sheets

SPIN MUFFLER

FIELD OF THE INVENTION

The field of the invention relates generally to systems and methods for attenuating acoustic noise in a gas flow, and more specifically to mufflers for reducing the high-intensity noise produced by internal combustion engines, gas compressors, air blowers and their associated piping, and various other vehicular and industrial applications.

BACKGROUND OF THE INVENTION AND RELATED ART

Prior art acoustic mufflers are generally of two types, friction type mufflers which place rigid barriers such as baffle plates with apertures into the path of the gas flow to break up and mix the sound waves, and absorption mufflers which absorb the sound waves in an acoustic damping material.

The friction type muffler is used most frequently, particularly on automobiles. This type of muffler typically has a casing with an inlet and outlet which can be positioned in a variety of locations, and a series of baffle plates there between to direct the gas flow in a circuitous route from inlet to outlet to cause mixing of the gas flow. Offset perforated inlet and outlet pipes may each extend the length of the casing to provide the circuitous route. Friction type mufflers are generally quite effective at reducing noise levels, but can also offer substantial resistance to gas flow because of the circuitous route followed by the exhaust gases passing through the muffler. Therefore, significant pressure is required to force the gases through the muffler. This additional pressure, referred to as back pressure, reduces the efficiency and power output of the source device being muffled.

The typical absorption type muffler has a casing with a pipe extending completely therethrough. A portion of the pipe inside the casing is perforated and the space between the pipe and casing is filled with sound absorbing fiberglass, ceramic fibers, or metallic wool mesh to absorb sound waves. By allowing the exhaust gases to pass directly through the muffler, the back pressure required to push the gas through the muffler is significantly reduced in comparison with friction type mufflers and more flow is obtained from the source device. However, the sound attenuation is often much less than that obtained with friction mufflers, making this type of muffler unacceptable in many applications.

Muffler acoustic efficiency is measured in decibels of noise attenuation (dba) versus gas flow in cubic feet per minute (CFM). When a pressure difference of 5 inches of water is imposed between the inlet and outlet, and using a common 2½ inch diameter muffler inlet and outlet, friction type mufflers have about 10-18 dba attenuation and 70-100 CFM flow. Absorption type straight through mufflers under those conditions have an attenuation of about 2-7 dba and 200 CFM flow.

There is a need in many applications for a muffler which has greater acoustic attenuation than the absorption type muffler, but with higher flow rates and less back pressure than the friction type mufflers.

SUMMARY OF THE INVENTION

In accordance with a representative embodiment broadly described herein, a muffler is provided for attenuating acoustic noise in a gas flow, and which includes a casing having an inlet and an outlet such that the gas flow passes through the casing from the inlet to the outlet. The muffler also includes one or more acoustic traps disposed within the casing which spans the distance between opposing top and bottom walls of the casing. The acoustic trap further includes a first arcuate deflector having a concave frontside surface configured to direct the gas flow from the inlet through a first segment of an expanding spiral revolution, and one or more second arcuate deflectors that are radially offset from the first arcuate deflector and configured to direct a portion of the gas flow through a remainder segment of the expanding spiral revolution.

In accordance with another representative embodiment broadly described herein, a muffler is provided for attenuating acoustic noise in a gas flow that includes a casing having an inlet and an outlet, such that the gas flow passes through the casing from the inlet to the outlet. The muffler also includes an inlet stub having a proximal end fluidly coupled to the inlet and a distal end penetrating an acoustic trap that is disposed within the casing, and which spans the distance between opposing top and bottom walls of the casing. The acoustic trap comprises a first arcuate deflector having a concave surface for receiving and directing the gas flow from the inlet stub through a first segment of an expanding spiral revolution, and one or more second arcuate deflectors that are radially offset outwardly from the first arcuate deflector for direct directing a majority portion of the gas flow through a remainder segment of the expanding spiral revolution.

In accordance with yet another representative embodiment broadly described herein, a muffler for attenuating acoustic noise in a gas flow is provided that includes a casing having an inlet and an outlet, such that the gas flow passes through the casing from the inlet to the outlet. The muffler also includes an inlet stub having a proximal end fluidly coupled to the inlet and a distal end penetrating an acoustic trap that is disposed within the casing, and which spans the distance between opposing top and bottom walls of the casing. The acoustic trap comprises a first arcuate deflector having a concave surface for receiving and directing the gas flow from the inlet stub through a first segment of an expanding spiral revolution, and one or more second arcuate deflectors that are radially offset inwardly from the first arcuate deflector for directing a minority portion of the gas flow through a remainder segment of the expanding spiral revolution. The muffler further includes one or more additional acoustic traps arranged in series with the acoustic trap and receiving a majority portion of the gas flow through the radial gap between the first arcuate deflector and the second arcuate deflector, and which is configured to form a gas vortex rotating in a direction opposite the expanding spiral revolution.

In accordance with yet another representative embodiment broadly described herein, a method is provided for attenuating acoustic noise in a gas flow. The method includes providing an inlet gas flow containing acoustic noise to a casing having an inlet and an outlet, receiving the inlet gas flow directly into an acoustic trap enclosed within the casing and which spans a distance between opposing top and bottom walls of the casing, and directing the gas flow through a first segment of an expanding spiral revolution. The method further includes bleeding off a first portion of the gas flow through a gap formed between the first arcuate deflector and at least one second arcuate deflector that is offset radially from the first arcuate deflector, and directing a second portion of the gas flow through a remainder segment of the expanding spiral revolution with the at least one second arcuate deflector.

In accordance with yet another representative embodiment broadly described herein, a muffler is provided attenuating acoustic noise in a gas flow. The muffler includes a casing having an inlet and an outlet, such that a gas flow passes through the casing from the inlet to the outlet, and a primary acoustic trap spanning a distance between opposing top and bottom walls of the casing that receives and directs the entire inlet gas flow through a first segment of an expanding spiral revolution. The muffler further includes one or more secondary acoustic traps that are arranged in series with the primary acoustic trap, and which receive and direct a first portion of the inlet gas flow into a gas vortex rotating in a direction opposite a direction of rotation of the expanding spiral revolution prior. Additionally, a remainder portion of the inlet gas flow is directed through a remainder segment of the expanding spiral revolution and about the outsides of the first and at least one second acoustic traps, prior to exiting the outlet.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which.

DETAILED DESCRIPTION OF EXEMPLARY EMBODIMENTS

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the invention is to be defined solely by the appended claims.

Furthermore, the following detailed description and representative embodiments of the invention will best understood with reference to the accompanying drawings, wherein the elements and features of the embodiments are designated by numerals throughout.

Illustrated in FIGS. 1-9 are several representative embodiments of a spin muffler for attenuating acoustic noise in a gas flow, such as the high-decibel engine noise which typically accompanies the flow of hot exhaust gases from internal combustion engines. The representative embodiments of the spin muffler also include one or more methods for attenuating acoustic noise in a gas flow. As described herein, the spin muffler provides several significant advantages and benefits over other types of muffler devices that are used to reduce acoustic noise in gas flows. However, the recited advantages are not meant to be limiting in any way, as one skilled in the art will appreciate that other advantages may also be realized upon practicing the invention.

Figure 1:
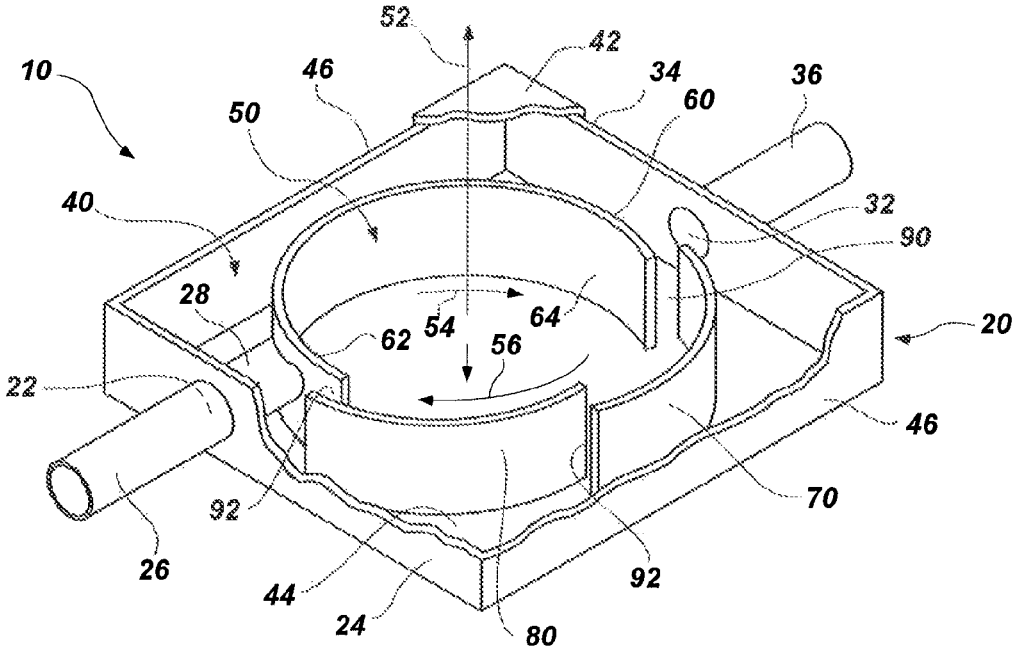
FIG. 1 is a perspective view of a spin muffler for attenuating noise is a gas flow, in accordance with a representative embodiment.

FIG. 1 is a perspective, cut-away view of a spin muffler 10 having an expanding-spiral acoustic trap 50 disposed inside an outer casing 20, in accordance with a representative embodiment. The casing 20 can be a generally rectangular, boxy shape that is shorter and wider than other muffler systems used in the same application, since it is one advantage that the spin muffler can provide for a greater reduction of noise inside a casing having a smaller footprint. In one aspect the casing can have rounded corners and weld seams on the top, bottom and/or sides as generated during the manufacturing process. As shown, the casing 20 includes an inlet opening 22 formed into an inlet wall 24, and an outlet opening 32 formed into an outlet wall 34 located opposite the inlet wall. The casing further includes a top wall 42, a bottom 44 wall and two sidewalls 46, which together with the inlet and outlet walls define an enclosed volume 40. Furthermore, the inlet opening 22 can be coupled to or around an inlet pipe 26, which can pass through the inlet wall 24 and project a predetermined distanced into the enclosed volume 40 of the casing to form an inlet stub 28. The outlet opening 32 can be coupled to or about an outlet pipe 36 that terminates flush with the inside surface of the outlet wall 34.

The acoustic trap 50 comprises a first arcuate deflector 60 or deflector plate that is disposed within the casing 20 and spans the distance between the opposing top 42 and bottom 44 walls. The inlet end 62 of the first arcuate deflector is penetrated by the inlet stub 28 or primary entry tube, so that the entire flow of inlet gases entering the casing 20 are directed immediately into the acoustic trap 50 and have no opportunity to flow elsewhere within the volume 40 enclosed by the casing. Once inside the acoustic trap, the gas flow contacts a concave frontside surface 64 of the first arcuate deflector 60, where it can be turned or directed through a first segment 54 of an expanding spiral revolution having a center axis 52 that is substantially-perpendicular and offset relative to the direction (e.g. vector) of the inlet gas flow. In other words, all of the inlet gas flow 2 entering the muffler can pass first through the inlet stub 28 and into the acoustic trap chamber at an off-center and near tangential location relative to a center axis 52 of the chamber, and can then be turned or rotated by the concave frontside surface 64 of the first actuate deflector 60 through a first segment 54 of an expanding spiral revolution that is centered about the axis 52.

The acoustic trap also comprises a second 70 and possibly a third 80 arcuate deflector or deflector plate that also spans the distance between the opposing top 42 and bottom 44 walls, and which are radially offset from the first arcuate deflector 60 and angled to form an expanding spiral revolution. Thus, a primary radial gap 90 is formed between the first deflector 60 and second deflector 70 that allows for a first portion of the inlet gases to be re-directed or bled off from the acoustic trap, and the one or more additional arcuate deflectors 70, 80 (which can be spirally concentric about the center axis 52 with first arcuate deflector 60) can direct a second portion of the gas flow through a remainder segment 56 of the expanding spiral revolution. As the second portion of the gas flow is directed by the additional arcuate deflectors, it can either join a rotating vortex of gas in the center of the acoustic trap 50 or exit the acoustic trap through secondary radial gaps 92 between the additional arcuate deflectors. Any exiting gas flow then circulates around the outside of the acoustic trap, but still within the volume 40 enclosed by the walls of the casing 20, to exit the muffler through the outlet opening 32.

Figure 2:
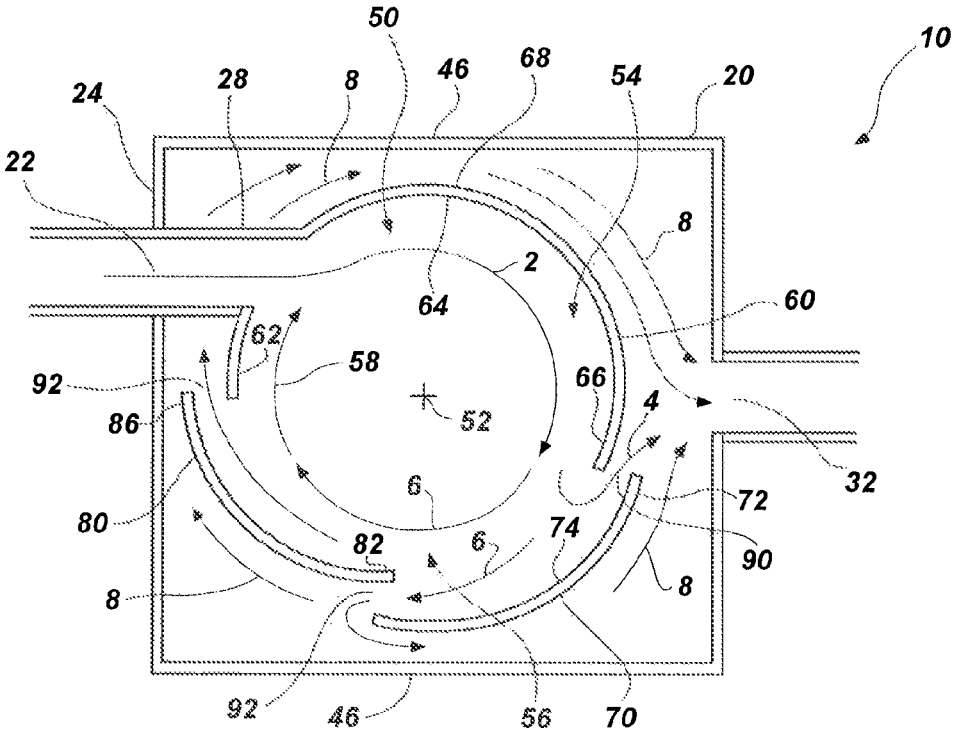
FIG. 2 is a top view of the spin muffler of FIG. 1 which illustrates the various flow paths of the gas as it moves through and about an acoustic trap disposed inside the muffler's outer casing.

FIG. 2 is a top view of the spin muffler 10 that serves to illustrates the subsequent paths of the inlet gas flow 2 through and about the various arcuate deflectors 60, 70, 80 after it enters the acoustic trap 50 disposed inside the muffler's outer casing 20. As can be seen, the inlet flow 2 enters the case through the inlet opening 22 that has been positioned off-center and to one side of the inlet wall 24 so as to enter the acoustic trap at a location and angle that is substantially tangential to the concave frontside face 64 of the first arcuate deflector 60. The entire inlet flow 2 is then rotated by the concave surface of the first deflector (in this case clockwise, as viewed from above along center axis 52) as it passes through the first segment 54 of an expanding spiral revolution. Alternatively the inlet flow can be rotated in the opposite direction (or counter-clockwise with respect to the inlet flow, as also viewed from above along center axis 52).

Upon reaching the trailing end 66 of the first arcuate deflector the inlet flow is allowed to split, and a first portion 4 of the inlet flow is bled off or allowed to exit the acoustic trap through the primary radial gap 90 formed between the trailing end 66 of the first arcuate deflector and the leading end 72 of the second arcuate deflector 70. As shown with the representative embodiment 10 of the spin muffler illustrated in FIGS. 1 and 2, the second arcuate deflector 70 can be radially offset outwardly from the first arcuate deflector 60, so that the first portion 4 of the inlet flow exiting the acoustic trap 50 through the primary radial gap may only be a minority portion of the overall inlet flow, as the momentum of the gas flow will tend to carry a second or majority portion 6 of the inlet flow 2 into the concave frontside 74 of the second arcuate deflector to again be directed around the remainder segment 56 of the expanding spiral revolution.

As the second portion 6 of the inlet flow 2 travels around the remainder segment 56 of the expanding spiral revolution, part of the gas flow can continue rotating around the axis 52 of the acoustic trap to form a central vortex 58. Most of the gas flow, however, can continue to expand outwardly and exit the acoustic trap 50 through the secondary gaps 92 between the trailing end of the second arcuate deflector and the leading end of a third arcuate deflector 80, and between the trailing end of the third arcuate deflector and the leading end 62 of the first arcuate deflector 60 as the gas flow passes through about 270 degrees of rotation. As shown in FIG. 2, the leading edge 82 of the third arcuate deflector 80 of the representative spin muffler 10 can be radially offset inwardly from the second arcuate deflector, but with an outwardly-angled orientation so that the trailing end 86 of the third arcuate deflector is still radially offset outwardly from the leading end 62 of the first arcuate deflector 60. Thus, both of the secondary gaps 92 can be configured to smoothly channel most of the second portion 6 of the inlet flow out of the acoustic trap 50 to become an outer flow 8.

After exiting the acoustic trap 50 much of the outer flow 8 can continue in the same direction of rotation and flow around the inlet stub 28 and into the outer passage between the convex backside surface 68 of the first arcuate deflector 60 and the sidewall 46 of the casing 20. However, some of the outer flow can reverse direction and continue around the outside of the acoustic trap between the convex backside surfaces of the one or more additional arcuate deflectors 70, 80 and the other sidewall 46, until all of the outer flows 8 meet and merge with the first portion 4 of the inlet flow and exit the casing through the outlet opening 32.

Mass flow is conserved throughout the spin muffler 10 during normal, steady-state operation, so that the total inlet flow 2 entering the casing 20 through the inlet opening 22 is balanced by the flow leaving the casing through outlet opening 32. Thus, even as some of the interior gas flow 6 continues to rotate with the central vortex 58, an equivalent portion leaves the central vortex to exit the acoustic trap through either the primary gap 90 or secondary gaps 92.

Other orientations and spacings between the two or more additional arcuate deflectors are possible, for example, to alter the direction and magnitudes of the portion of the inlet flow entering the central vortex, or the flowrates of the various exit streams leaving the acoustic trap around the perimeter of the expanding spiral revolution. Some of these different configurations are illustrated in the embodiments discussed below. However, it is to be appreciated that other configurations for the additional arcuate deflectors or deflector plates which are not illustrated or described herein, but which are also operable to direct a portion of the inlet gas flow through a remainder segment of the expanding spiral revolution prior to exiting the outlet, can each be considered to fall within the scope of the present invention.

One benefit of the spin muffler which results from using the acoustic trap 50 to induce the rotation of the entire inlet flow 2 about an axis of rotation 52 is that the sound waves are re-directed and folded back upon themselves, so that much of the organized energy of vibration contained in the sound waves is broken up, randomized and converted to heat as the vibrations within the moving gas are thrown into each other in the vortex. In other words, the acoustic trap takes advantage of the principle of entropy and uses the swirling flow to convert the organized sound energy into disorganized heat energy, but with less pressure drop and within a smaller volume than other types of sound attenuating devices which use friction or absorption to reduce the noise levels. Converting the sound energy to heat energy can raise the temperature of the gas a few degrees, but because the inlet gas may comprise high-temperature exhaust gases flowing from an internal combustion engine, the proportional increase in temperature may often be negligible.

Figure 3A:
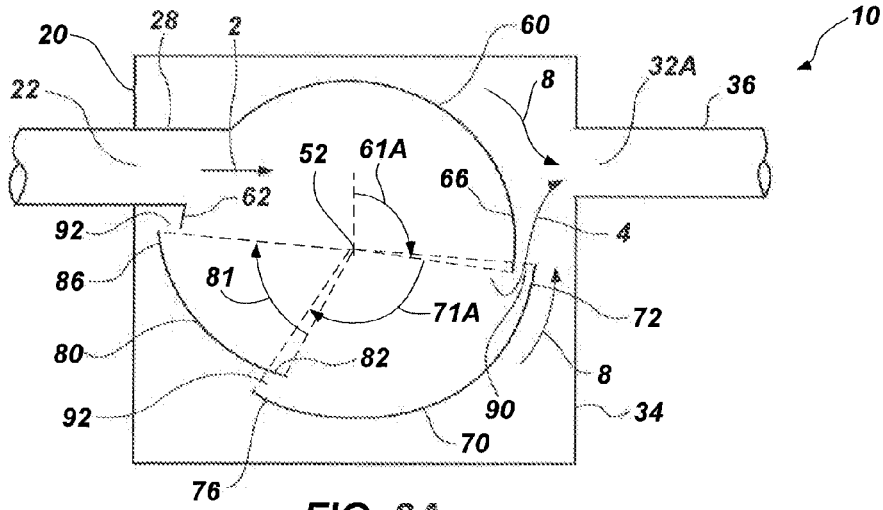
FIGS. 3A-3C are top views that together illustrate various configurations for the acoustic trap of the spin muffler of FIG. 1.
Figure 3B:
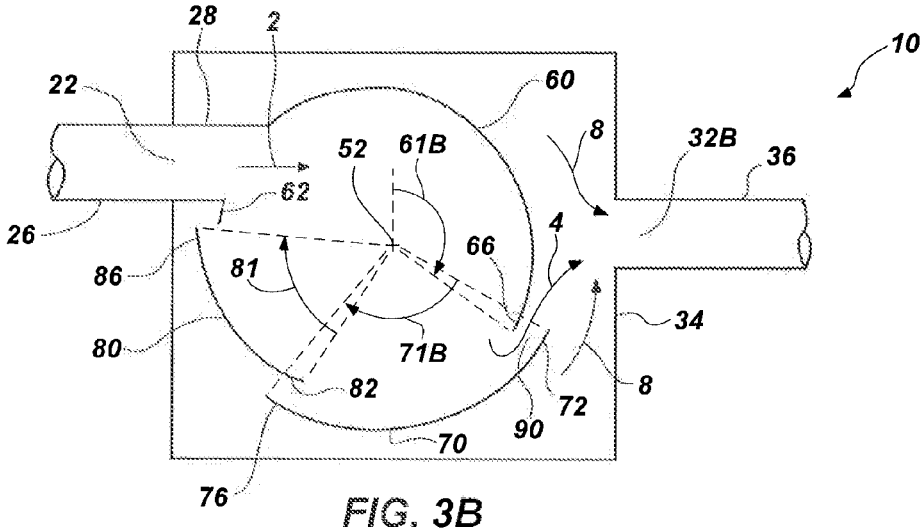
Figure 3C:
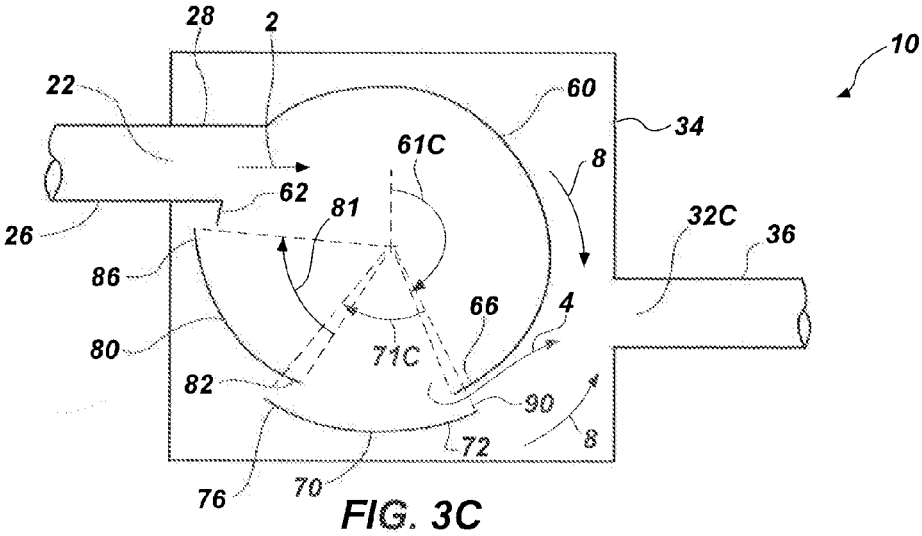

Referring now to FIGS. 3A-3C, illustrated therein are three representative arrangements of the spin muffler 10 having a first arcuate deflector 60, a second arcuate deflector 70 radially offset from the first arcuate deflector to create the primary radial gap 90, and a third arcuate deflector 80 radially offset from both the trailing end 76 of the second arcuate deflector 70 and the leading end 62 of the first arcuate deflector 60 to create two secondary radial gaps 92. All three arcuate deflectors 60, 70, 80 can be spirally concentric about the center axis 52. Furthermore, the primary and secondary radial gaps can be full-height openings that extend between the top and bottom walls of the casing 20, and can be sufficiently wide so that the summed cross-sectional area of all three radials gaps can be greater than the total cross-sectional area of the inlet opening 22.

As can also be seen in FIGS. 3A-3C, the location of the outlet opening 32A, 32B, 32C and outlet pipe 36 can vary across the length of the outlet wall 34, even as the inlet opening 22 and inlet pipe 26 are fixed at a particular offset location along the inlet wall 24. As the location of the outlet opening is shifted, the location of the primary gap 90 (as defined by the trailing end 66 of the first arcuate deflector 60 and the leading end 72 of the second arcuate deflector 70) can also shift to keep the first portion 4 of the inlet flow substantially aligned with the outlet opening as it exits the acoustic trap 50 through the primary gap 90. Having the primary gap 90 substantially aligned with the outlet opening can provide additional beneficial effects by reducing the head loss through the spin muffler 10, both by creating a direct flow path for the first portion flow 4 and by forming a gas stream that operates to gather and direct the converging outer flows 8 from both sides of the acoustic trap 50 into the outlet opening.

In one aspect, the are length of the three arcuate deflectors 60, 70, 80 may be modified as needed to keep the location of the primary gap 90 substantially aligned with the outlet opening. For instance, as shown in FIG. 3A, the are length 61A of the first arcuate deflector 60 (not including the leading half of the deflector 62 that is coupled to the inlet stub 28) can extend from about zero degrees to about one hundred ten degrees relative to the inlet gas flow 2 at the trailing end 66. Likewise, the are length 71A of the second arcuate deflector 70 can extend from about one hundred degrees relative to the inlet gas flow at the leading end 72 to about two hundred twenty degrees at the trailing end 76, and the are length 81 of the third arcuate deflector 80 can extend from about two hundred degrees relative to the inlet gas flow at the leading end 82 to about two hundred seventy degrees at the trailing end 86. Thus, the outwardly-offset leading end 72 of the second deflector can overlap the trailing end 66 of the first deflector by an are length of about five to ten degrees, providing a primary gap 90 that forms a short passage between the inside and the outside of the acoustic trap that is directed towards an outlet opening 32A offset to the same side of the casing 20 as the inlet opening 22.

As shown in FIG. 3B, the outlet opening 3213 can be located at about the center of the outlet wall 34. In this configuration the are length 6113 of the first arcuate deflector 60 (again, not including the leading half of the deflector 62 that is coupled to the inlet stub 28) can extend from about zero degrees to about one hundred thirty five degrees relative to the inlet gas flow 2 at the trailing end 66. Likewise, the are length 71B of the second arcuate deflector 70 can extend from about one hundred twenty five degrees relative to the inlet gas flow at the leading end 72 to about two hundred twenty degrees at the trailing end 76, and the are length 81 of the third arcuate deflector 80 can extend from about two hundred degrees relative to the inlet gas flow at the leading end 82 to about two hundred seventy degrees at the trailing end 86. Thus, in FIG. 3B the outwardly-offset leading end 72 of the second deflector can again overlap the trailing end 66 of the first deflector by an are length of about five to ten degrees, providing a primary gap 90 with a short passage having an axis directed towards the outlet opening 32B located at about the center of the outer sidewall 34.

In FIG. 3C, moreover, the outlet opening 32 can be offset to the opposite side of the casing 20 as the inlet opening 22. In this configuration the are length 61C of the first arcuate deflector 60 (not including the leading half of the deflector 62 that is coupled to the inlet stub 28) can extend from about zero degrees to about one hundred seventy degrees relative to the inlet gas flow at the trailing end 66. Likewise, the are length 71C of the second arcuate deflector 70 can extend from about one hundred sixty degrees relative to the inlet gas flow at the leading end 72 to about two hundred twenty degrees at the trailing end 76, and the are length 81 of the third arcuate deflector 80 can extend from about two hundred degrees relative to the inlet gas flow at the leading end 82 to about two hundred seventy degrees at the trailing end 86. Thus, in FIG. 3C the outwardly-offset leading end 72 of the second deflector can again overlap the trailing end 66 of the first deflector by an are length of about five to ten degrees, providing a primary gap 90 with a short passage having an axis directed towards the outlet opening 32C offset to the opposite side of the casing 20 as the inlet opening 22.

Figure 4:
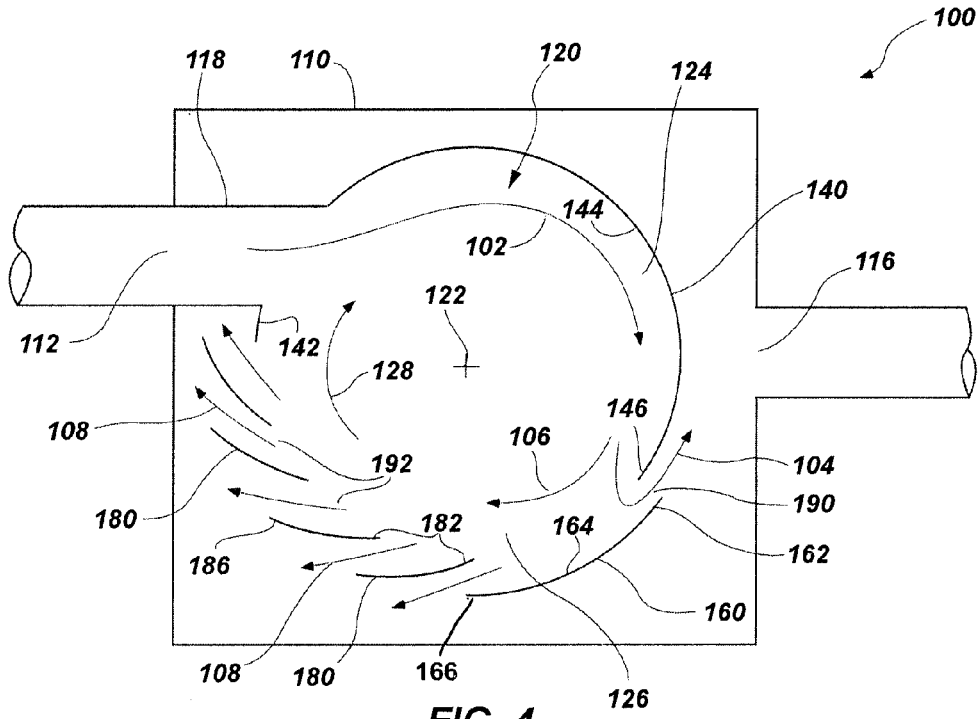
FIG. 4 is a top view of a spin muffler illustrating flow paths through and about an acoustic trap, in accordance with another representative embodiment.

Illustrated in FIG. 4 is a top view of another spin muffler embodiment 100 having a single expanding-spiral acoustic trap 120 comprised of multiple arcuate deflectors or deflector plates. The spin muffler can include a casing 110 having an inlet 112 and an outlet 116, and can be configured so that an entire inlet gas flow 102 entering the casing 110 is directed through an inlet stub 118 which penetrates the leading end 142 of a first arcuate deflector 140. Upon entry into the acoustic trap 120 the inlet flow 102 can be directed against the concave frontside surface 144 of the first arcuate deflector 140, which turns and directs the gas flow 102 through a first segment 124 of an expanding spiral revolution about a center axis 122 that is radially offset and substantially-perpendicular to the direction (e.g. vector) of the inlet gas flow 102.

The spin muffler 100 can also include one or more additional arcuate deflectors 160, 180 that are radially offset from the first arcuate deflector 140 and configured to direct a portion 106 of the gas flow through a remainder segment 126 of the expanding spiral revolution prior to exiting the outlet 116. As can be seen in FIG. 4, the additional arcuate deflectors 160, 180 can also be spirally concentric about the center axis 122 with the first arcuate deflector 140, and can span the entire distance between the top and bottom walls of the casing so that the gas flow entering the acoustic trap is forced to exit the acoustic trap 120 through the one of the primary 190 or secondary 192 gaps prior to reaching the muffler outlet 116.

As illustrated in FIG. 4, the one or more additional arcuate deflectors 160, 180 of the spin muffler 100 can include a second arcuate deflector 160 and a plurality of third arcuate deflectors 180. The second arcuate deflector 160 can be radially offset outwardly (as shown) or inwardly (not shown) from the first arcuate deflector 140 and angled to form an expanding spiral revolution, and with the leading end 162 of the second arcuate deflector overlapping the outside of the trailing end 146 of the first arcuate deflector by an arc length of about five to ten degrees to form a primary gap 190 having a short passage between the inside and the outside of the acoustic trap that is directed towards the outlet opening 116. Since the second arcuate deflector is radially offset outwardly from the first arcuate deflector, only a first minority portion 104 of the inlet gas flow 102 may bleed off or exit through the primary gap 190, with a second majority portion 106 being directed by the concave frontside surface 164 of the second arcuate deflector 160 around the remainder segment 126 of the expanding spiral revolution.

The leading end 182 of each of the plurality of third arcuate deflectors 180 can be radially offset inwardly from the trailing end 166, 186 of the second arcuate deflector or of the preceding third arcuate deflector, respectively, but with an outwardly-angled orientation so that the trailing ends 186 of each of the third arcuate deflectors is radially offset outwardly from the leading ends 142, 182 of the first arcuate deflector 160 or a subsequent third arcuate deflector 180. Thus, each of the secondary gaps 192 can be configured to smoothly channel most of the second portion 106 of the inlet flow out of the acoustic trap 120 to become an outer flow 108, while part of the second portion 106 continues rotating around the axis 122 of the acoustic trap to form a central vortex 128. Alternatively, the orientation of the plurality of the third arcuate deflectors 180 can be reversed so that most of the second portion 106 of the inlet flow is reversed in direction as it flows out of the acoustic trap.

Similar to the previous embodiment described above, all of the primary 190 and secondary 192 radial gaps can be full-height openings that extend between the top and bottom walls of the casing 110, and can be sufficiently wide so that the summed cross-sectional area of all the radials gaps can be greater than the total cross-sectional area of the inlet opening 112. Moreover, mass flow is conserved throughout the spin muffler 100 during normal, steady-state operation, so that the total inlet flow 102 entering the casing 110 through the inlet opening 112 is balanced by the flow leaving the casing through outlet opening 116. Moreover, even as some of the second portion 106 of the gas flow continues to rotate with the central vortex 128, an equivalent amount leaves the vortex to exit the acoustic trap 120 through either the primary or secondary gaps 190, 192.

Figure 5:
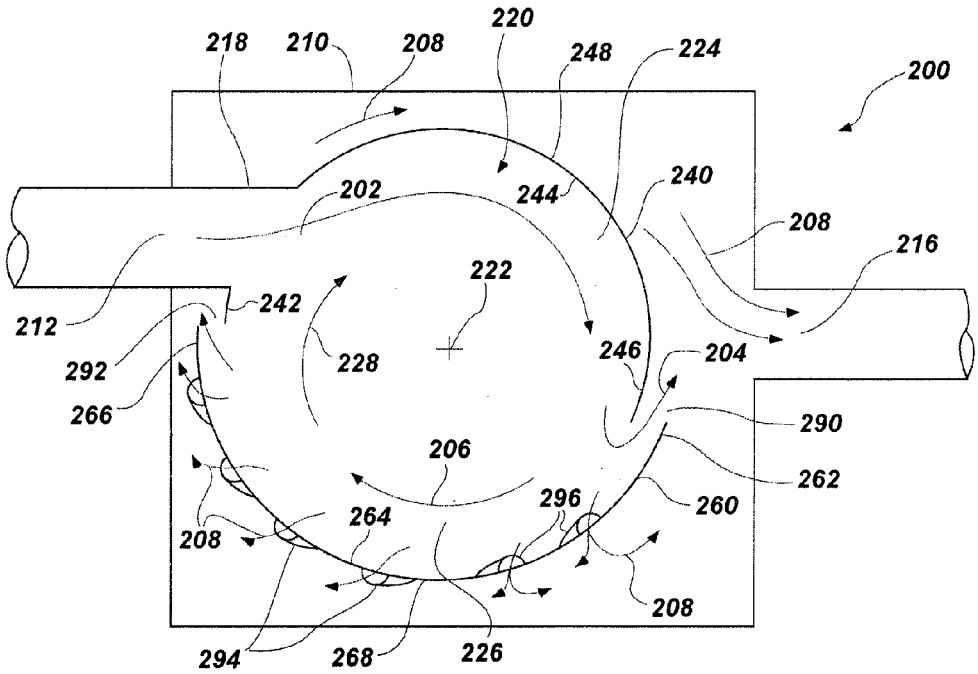
FIG. 5 is a top view of a spin muffler illustrating flow paths through and about an acoustic trap, in accordance with yet another representative embodiment.

Referring now to FIG. 5, illustrated therein is a top view of a spin muffler 200 having a single expanding-spiral acoustic trap 220 comprised of multiple arcuate deflectors or deflector plates, in accordance with another representative embodiment. The spin muffler can include a casing 210 having an inlet 212 and an outlet 216, and configured so that an entire inlet gas flow 202 entering the casing 210 is directed through an inlet stub 218 which penetrates the leading end 242 of a first arcuate deflector 240. Upon entry into the acoustic trap 220 the inlet flow 202 can be directed against the concave frontside surface 244 of the first arcuate deflector 240, which turns and directs the gas flow 202 through a first segment 224 of an expanding spiral revolution about a center axis 222 that is radially offset and substantially-perpendicular to the direction (e.g. vector) of the inlet gas flow 202.

The spin muffler 200 can further include a single additional or second arcuate deflector 260 that is radially offset from the first arcuate deflector 240 and spirally concentric about the center axis 222 with the first arcuate deflector 240. Both the first and second arcuate deflectors forming the acoustic trap 220 can span the entire distance between the top and bottom walls of the casing, so that the entire inlet gas flow entering the acoustic trap is forced to exit through either the primary gap 290, the secondary gap 292 (if present), or through one of a plurality of openings 294, 296 formed through the thickness of the second arcuate deflector 260 prior to reaching the outlet opening 216.

As can be seen, the second arcuate deflector 260 can be radially offset in the outward direction from the first arcuate deflector 240 and angled to form an expanding spiral revolution, and with the leading end 262 of the second deflector overlapping the outside of the trailing end 246 of the first deflector by an are length of about five to ten degrees to form a primary gap 290 or passage between the inside and the outside of the acoustic trap that is directed towards the outlet opening 216. Since the second arcuate deflector is radially offset outwardly from the first arcuate deflector, only a first minority portion 204 of the inlet gas flow 202 may bleed off or exit through the primary gap 290, with a second majority portion 206 being directed by the concave frontside surface 264 of the second arcuate deflector around the remainder segment 226 of the expanding spiral revolution prior to exiting the outlet 216.

Furthermore, the trailing end 266 of the second arcuate deflector 260 can be offset outwardly from the leading end 242 of the first arcuate deflector to form a secondary radial gap 292 or passage which smoothly channels a part of the second portion 206 of the inlet flow out of the acoustic trap 220, even as another part of the second portion 206 continues to rotate around the axis 222 in a central vortex 228.

The second portion 206 of the inlet flow can also exit the acoustic trap 220 through the plurality of openings 294, 296 formed through the thickness of the second arcuate deflector 260. In the embodiment 200 illustrated, the openings 294, 296 can be louver openings punched through the sheet metal forming the second arcuate deflector, each having a semi-circular mouth that gradually tapers down to the surface of the deflector. In one aspect the louver openings 294 can be punched in a forward direction from the inside-out, to smoothly channel the second portion 206 of the inlet flow out of the acoustic trap 220 to become an outer flow 208 that continues in the same direction of rotation as the spiral revolution. This outer flow spills around the inlet stub 218 and into the outer passages between the convex backside surface 248 of the first arcuate deflector 240 and the sidewall of the casing 210. In another aspect, however, some of the louver openings 296 can be punched in the reverse direction and from the outside-in to create a "scoop" effect that captures part of the second portion 206, allowing the outer flow 208 to travel in either direction between the convex backside surfaces 268 of the second arcuate deflector 260 and the sidewall of the casing 210.

As can be appreciated, the summation of the cross-sectional area of the full-height primary 290 and secondary 292 radial gaps and of the louver openings 294, 296 can be greater than the total cross-sectional area of the inlet opening 212, to prevent any undesirable increase in back pressure as the gas flows into and out of the acoustic trap. Moreover, mass flow can be conserved across the spin muffler 200 during normal, steady-state operation, so that the total inlet flow 202 entering the casing 210 through the inlet opening 212 is balanced by the flow leaving the casing through outlet opening 216. Thus, even as some of the second portion 206 of the inlet gas flow continues to rotate within the central vortex 228, an equivalent amount leaves the central vortex to exit the acoustic trap 220, either through the primary gap 290, the secondary gap 292 or the through the louver openings 294, 296.

Figure 6:
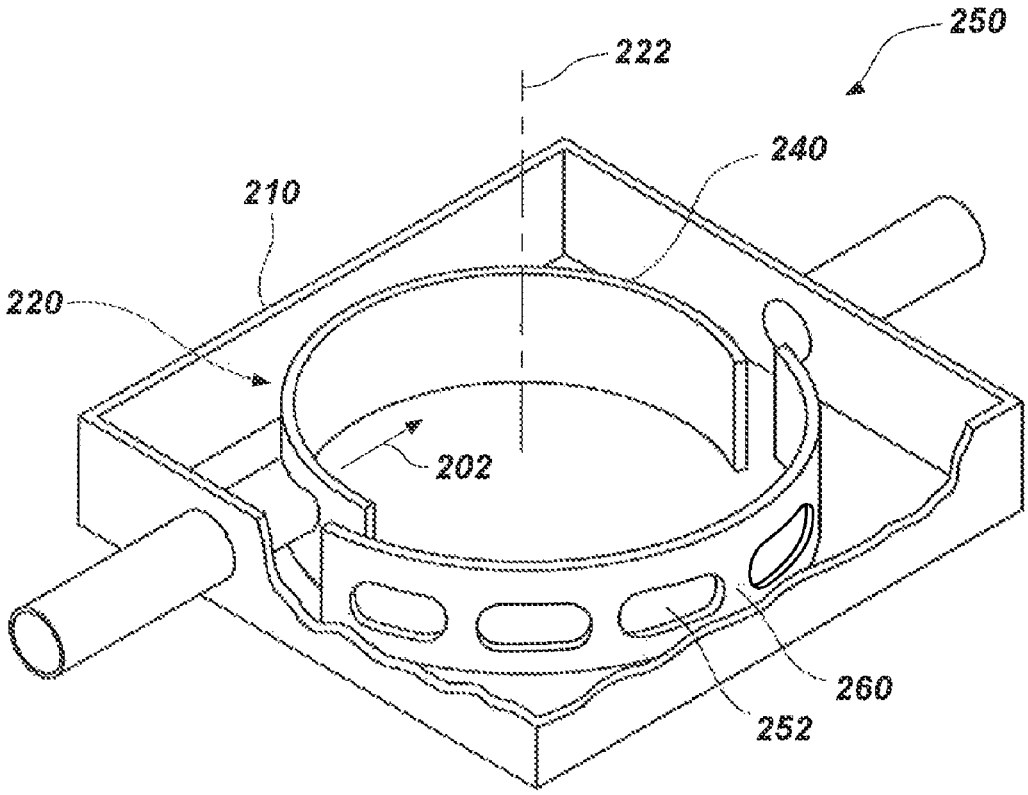
FIG. 6 is a perspective view of a spin muffler, in accordance with a yet another representative embodiment.

Illustrated in FIG. 6 is another representative spin muffler 250 having an outer casing 210 that encloses a single acoustic trap 220 comprised of a first arcuate deflector 240 and a second arcuate deflector 260 which is offset radially outwardly from the first arcuate deflector. Similar to the embodiment described and illustrated in FIG. 5 above, the two arcuate deflectors 240, 260 can operate together to direct the entire flow of inlet gas 202 through at least part of an expanding spiral revolution having a center axis 222 that is radially offset and substantially-perpendicular to the direction (e.g. vector) of the inlet gas flow. As can be seen, however, the spin muffler 250 can have a different type of aperture 252 formed into the second arcuate deflector 260 than the louver openings described above. As shown in FIG. 6, for instance, the apertures can be obround openings such as elongated slots with rounded ends. Moreover, it is to be appreciated that the apertures 252 can be provided in a wide variety of shapes and sizes. The apertures can have a NACA-duct shape, for instance, which is a generally triangular shape having its apex pointed against the direction of flow and with outwardlycurving sides configured to create opposing vortexes which help to direct the flow through the aperture. Moreover, other embodiments having triangular, square, rectangular, diamond, polygonal, round, slotted, oblong, hemispherical or pie-shaped apertures, etc., and combinations thereof, can also be considered to fall within the scope of the present invention.

Figure 7:
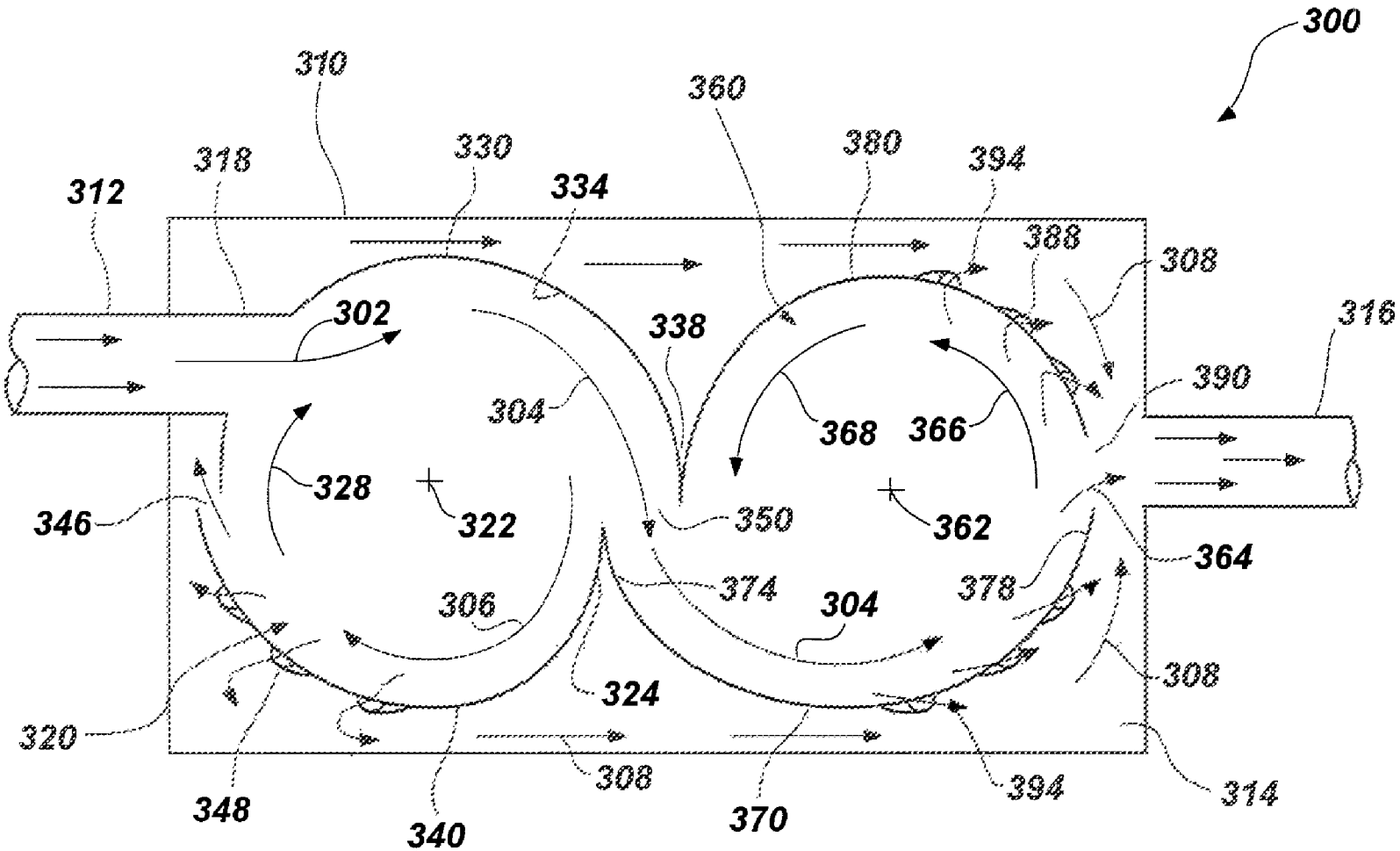
FIG. 7 is a top view of a spin muffler, in accordance with a yet another representative embodiment.

FIG. 7 is a top view of another representative embodiment 300 of the spin muffler having a primary acoustic trap 320 and a secondary acoustic trap 360 which can be arranged in series with the primary acoustic trap. As with the embodiments described above, the spin muffler 300 can have an inlet gas flow 302 entering the primary acoustic trap 320 through an inlet stub 318 connected to an inlet opening 312 in the sidewall of the casing 310, so that the entire inlet gas flow 302 is received by the first arcuate deflector 330 of the primary acoustic trap and directed through a first segment of an expanding spiral revolution, as defined by the concave frontside surface 334 of the first arcuate deflector 330. The expanding spiral revolution can have a center axis 322 that is radially offset and substantially-perpendicular to the direction (e.g. vector) of the inlet gas flow.

After passing through the first segment of the expanding spiral revolution, a first portion 304 of the inlet gas flow 302 can be drawn off from the primary acoustic trap 320 and re-directed towards the secondary acoustic trap 360, where some of the first portion 304 can then join the second gas vortex 368 spinning in the center of the secondary trap. The remainder of the first portion 304 can exit the secondary acoustic trap either through a circumferential gap 390 or through vents or apertures 388 formed through rearward sections of the one or more additional arcuate deflectors 370, 380 which define the boundaries of the secondary acoustic trap 360. The primary 320 and secondary 360 acoustic traps can both span the entire distance between the top and bottom walls of the casing, and can be configured so that the second gas vortex 368 rotates in a direction opposite the direction of rotation of the expanding spiral revolution or central vortex 328 in the primary acoustic trap.

Meanwhile, the second portion 306 of the inlet gas flow 302 can continue through the remainder segment of the expanding spiral revolution within the primary acoustic trap 320, with some of the second portion entering the central vortex 328 while the rest exits the primary trap 320 through a plurality of secondary gaps 346 or openings 348 in the one or more additional arcuate deflectors 340 forming the boundaries of the primary acoustic trap. Once outside of the primary acoustic trap, the outer flows 308 can travel in both directions around the convex outside surfaces of the arcuate deflectors 330, 340 and around both sides of the second acoustic trap 360 towards the outlet, until the outer flows 308 rejoin with the first portion 364 and exit together through the outlet opening 316 of the spin muffler 300.

As previously described, spinning the flowing gases in a vortex in an acoustic trap can break up and randomize the sound vibrations present in the gas flow through the application of the principle of entropy, so that the organized sound energy is folded back upon itself and reduced into disorganized heat energy which can readily be assimilated into the flowing gas. It can be appreciated by one of skill in the art that any individual acoustic trap can provide a fixed amount of reduction in sound energy which, depending upon the sound levels generated by the source of the acoustic noise, may or may not be sufficient to reduce the sound intensity to acceptable levels. Thus, in cases where one acoustic trap is insufficient, one or more additional acoustic traps can be fluidly coupled in series to the first acoustic trap, as shown in FIG. 7, with each additional acoustic trap providing an additional incremental transformation of the remaining sound energy into heat energy.

In one aspect the reduction in sound energy can be in absolute terms, such as a reduction in sound intensity ranging from 5 dB to 15 dB. The number of acoustic traps 340, 360 included in the spin muffler 300 can be increased as needed to provide the desired reduction in sound with the smallest possible pressure drop from the inlet opening 312 to the outlet opening 316.

As can also be seen, the first portion 304 of the inlet gas flow 302 can be drawn off from the primary acoustic trap 320 and re-directed into the secondary acoustic trap 360 by positioning the leading end 324 of the second arcuate deflector 340 in a position that is offset radially inward from the trailing end 338 of the first arcuate deflector 330. This can have the effect of drawing off the majority of the first portion 304 of the gas flow as it passes through the primary radial gap 350 between the first arcuate deflector 330 and the second arcuate deflector 340. Moreover, the leading end 324 of the second arcuate deflector can connect or merge with the leading end 374 of a larger arcuate deflector 370 of the second acoustic trap 360, to form a pointed flow splitter that separates the first portion 304 of the inlet flow from the second portion 306.

The second acoustic trap 360 can comprise the larger arcuate deflector 370 that receives the first portion 304 of the inlet flow and directs it around the first half of a contracting spiral revolution, and a smaller arcuate deflector 380 which directs the remainder 366 of the first portion around the rest of the contracting spiral revolution to establish the second vortex 368 rotating about spin axis 362. A circumferential gap 390 can separate the trailing end 378 of the larger arcuate deflector 370 from the leading end of the smaller arcuate deflector 380. In one aspect, the circumferential gap 390 can be substantially aligned with the outlet opening 316 so that part of the first portion of the inlet flow traveling through the second acoustic trap flows immediately towards the outlet, where it combines with the outer flows 308 to exit together through the outlet opening 316 of the spin muffler.

As illustrated in FIG. 7, the vents or apertures 348 in both the additional arcuate deflector 340 in the primary acoustic trap 320, and the vents or apertures 388 formed through the rearward sections of the larger 370 and smaller arcuate deflectors 380 can be louver openings. The louver openings can be punched in the forward direction, from the inside-out, to smoothly channel the rotating gas channel flow 394 out of the acoustic traps 320, 360 and into the outer volume 314 outside of the acoustic traps but still enclosed the casing 310. The louver openings can also be punched in the reverse direction, and from the outside-in, to create a "scoop" effect which captures a greater part of the rotating gas flow to direct it into the outer volume 314. The vents or apertures 348, 388 can also be apertures of a variety of different shapes and sizes, such as the NACA-ducts described above, or triangular, square, rectangular, diamond, polygonal, round, obround, oblong, slotted hemispherical or pie-shaped apertures, etc., and combinations thereof.

Mass flow can also be conserved across the spin muffler 300 during normal, steady-state operation, so that the total inlet flow 302 of gases entering the casing 310 through the inlet opening 312 is balanced by the gas flow leaving the casing through outlet opening 316. Thus, even as some of the second portion 306 of the inlet gas flow 302 continues to rotate within the central vortex 328 in the primary acoustic trap 320, and some of the first portion 304 of the inlet gas flow 302 continues to rotate within the second gas vortex 368 spinning in the center of the secondary acoustic trap 360, equivalent amounts of gas leave both the central and second vortexes to exit the acoustic traps 320, 360 through either the gaps 346, 390 or through the vents or apertures 348, 388. Furthermore, the summation of the cross-sectional area of the full-height radial and circumferential gaps 346, 390 and of the vents or apertures 348, 378, 388 can be greater than the total cross-sectional area of the inlet opening 312 to limit any undesirable increase in back pressure as the gas flows through the acoustic trap 300.

Figure 8A:
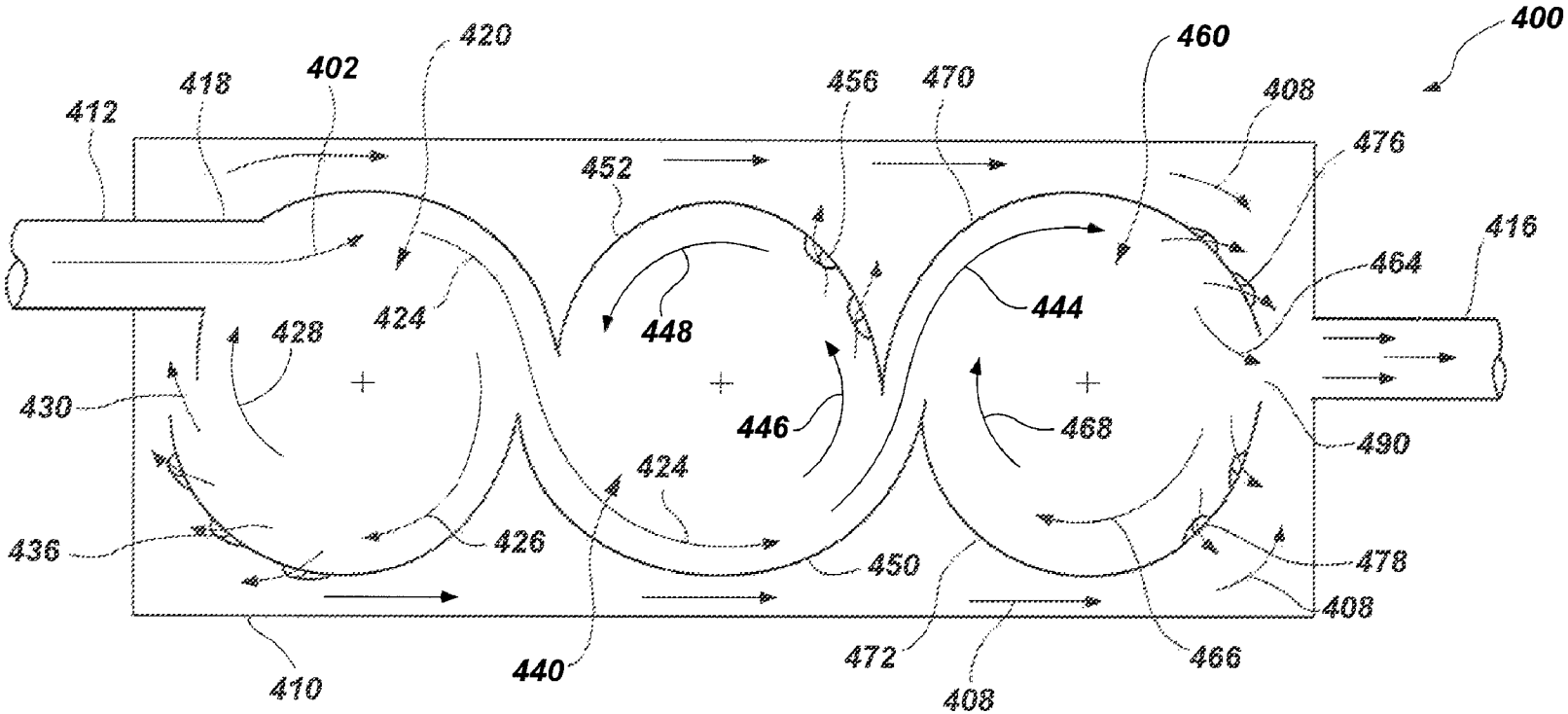
FIGS. 8A and 8B together illustrate top views of additional representative embodiments of the spin muffler.
Figure 8B:
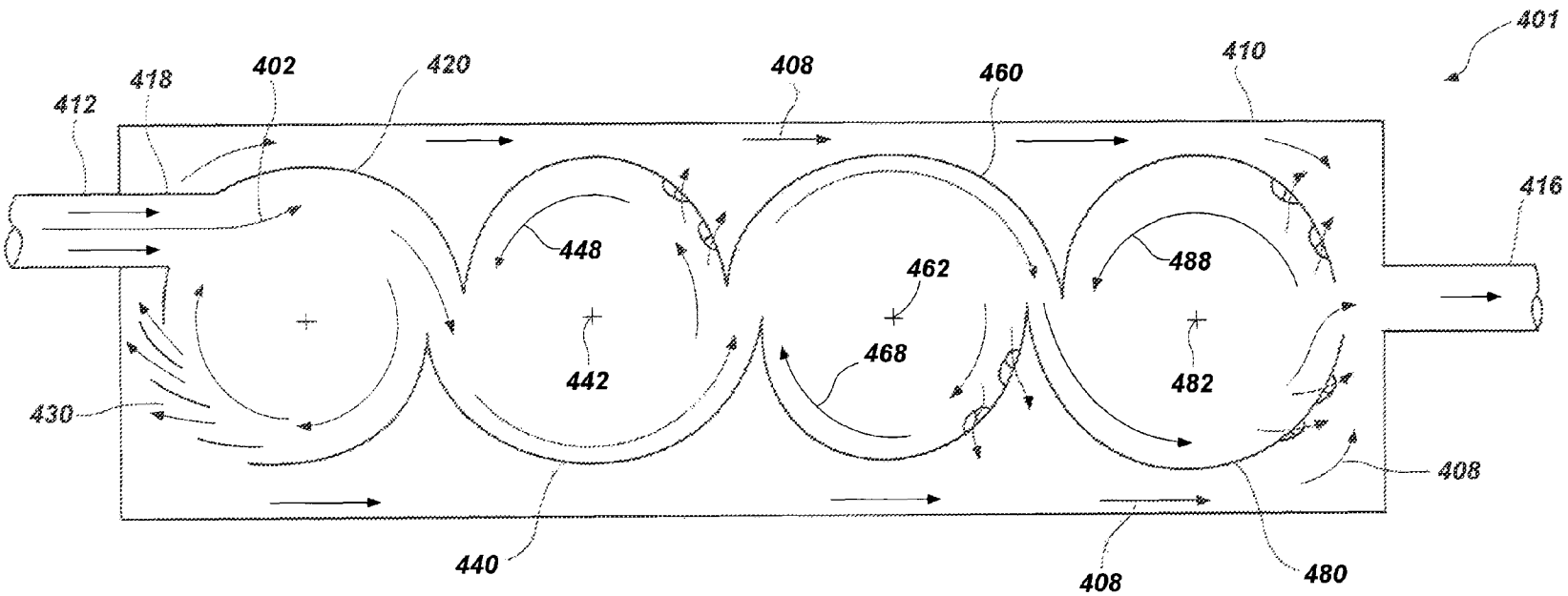

FIGS. 8A and 8B illustrate top views of two additional embodiments 400, 401 of the spin muffler, each having a primary acoustic trap 420 and two or more secondary acoustic traps arranged in series with the primary acoustic trap, and where the rotating gas vortex in each subsequent acoustic trap rotates in a direction opposite the rotating vortex in the preceding acoustic trap. As before, each of the primary acoustic and two or more secondary acoustic traps can span the entire distance between the top and bottom walls of the casing 410 of the spin muffler 400, 401.

Referring first to FIG. 8A, the primary acoustic trap 420 can be coupled in series to a second acoustic trap 440 and a third 460 acoustic trap, each of which receives a steadily decreasing or diminishing portion of the inlet flow 402 which first enters the primary acoustic trap 420 through inlet opening 412 by way of the inlet stub 418. This occurs because majority portions 424, 444 of the gas flowing within the preceding acoustic traps 420, 440 are drawn off and directed into the subsequent acoustic traps 440, 460, respectively, but with minority portions 426, 446 either being drawn into a rotating vortex 428, 448 or exiting out of the trap through secondary gaps 430 or side apertures 436, 456 to join an outer flow 408. Additionally, a large portion 464 of the gas flow 444 reaching the last acoustic trap 460 can exit directly through the circumferential gap 490, allowing another minority portion 466 to either be drawn into a rotating vortex 468 or exiting out through side apertures 476, 478. In one aspect the circumferential gap 490 can be substantially aligned with the outlet opening 416 in the casing 410, so that gas flow 464 exiting through the circumferential gap 490 can form a gas stream that gathers and collects the outer flows 408 converging from both sides of the last acoustic trap 460 prior to exiting through the outlet opening 416.

As can be seen, the two additional or subsequent acoustic traps 440, 460 both include a larger arcuate deflector 450, 470, respectively, that receives the majority portion 424, 444 of the gas flow from the preceding acoustic trap and directs it around the first half of a contracting spiral revolution. The traps also include smaller arcuate deflectors 452, 472, respectively, that direct the remainder of the gas flow 446, 466 around the rest of the contracting spiral revolution to establish the additional vortexes 448, 468 rotating about spin axis 442, 462, respectively. The location of the larger and smaller arcuate deflectors can alternate from side to side within the spin muffler casing 410, so that the rotating gas vortex in each subsequent acoustic trap rotates in a direction opposite the rotating vortex in the preceding acoustic trap. As further shown with the embodiment 401 illustrated in FIG. 8B, the arrangement of alternating larger and smaller arcuate deflectors can be continued as additional secondary acoustic traps 440, 460, 480, etc., are added within the spin muffler casing 410 to generate additional vortexes 448, 468, 488 rotating about spin axis 442, 462, 482, respectively. As described above, these additional which vortexes can make use of the principle of entropy to incrementally reduce the sound intensity of the inlet gas flow 402 to acceptable levels when it eventually exits the spin muffler outlet through outlet 416.

Figure 9:
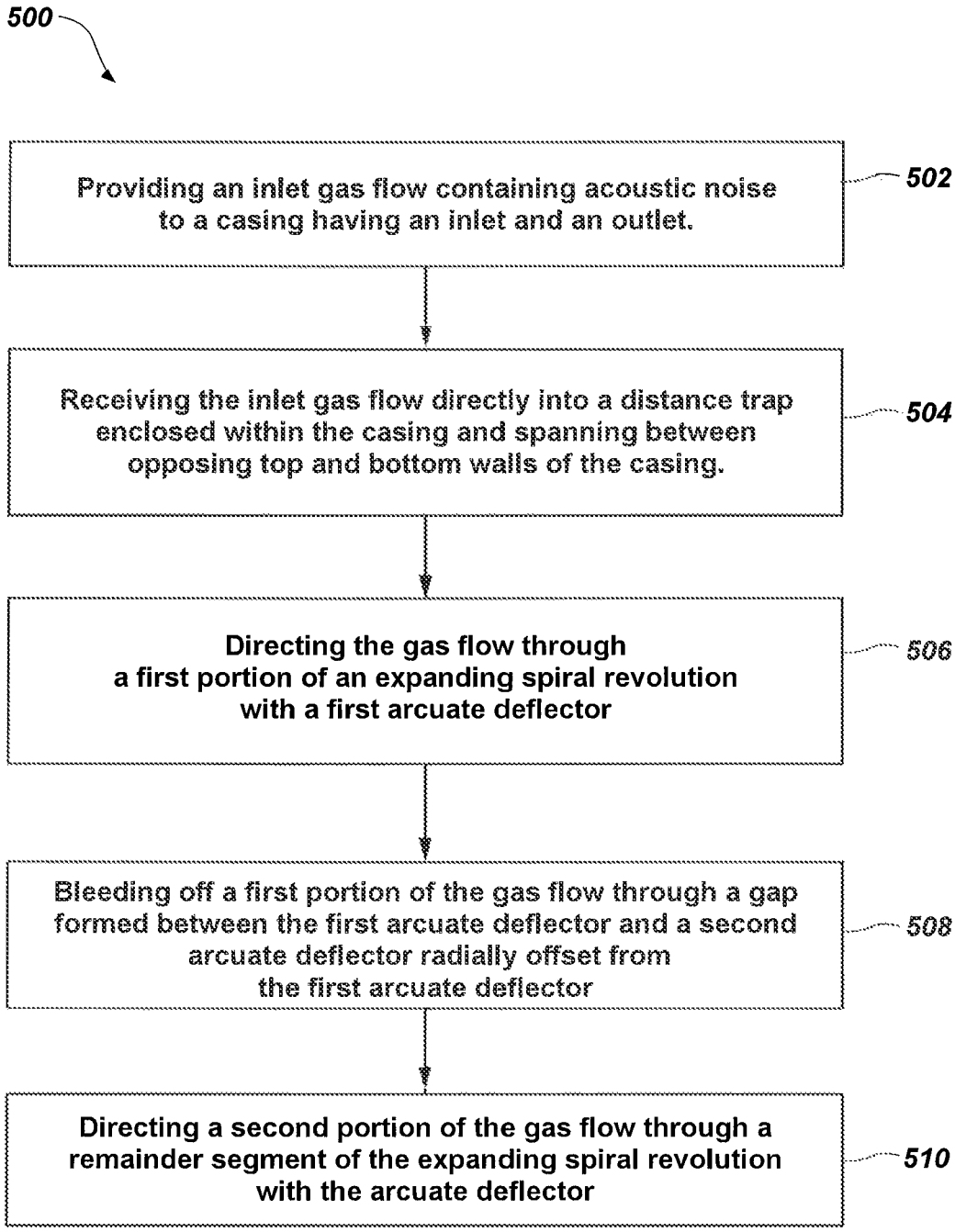
FIG. 9 is a flowchart depicting a method for attenuating acoustic noise in a gas flow, in accordance with a yet another representative embodiment.

FIG. 9 is a flowchart depicting a method 500 for attenuating acoustic noise in a gas flow, in accordance with a yet another representative embodiment. The method 500 includes the steps of providing 502 an inlet gas flow that contains acoustic noise to a spin muffler casing having an inlet and an outlet, and receiving 504 the inlet gas flow directly into an acoustic trap that is enclosed within the casing and which spans the distance between the opposing top and bottom walls of the casing. The method also includes the steps of directing 506 the gas flow, with a first arcuate deflector, through a first segment of an expanding spiral revolution, and bleeding 508 off a first portion of the gas flow through a gap formed between the first arcuate deflector and at least one second arcuate deflector that is offset radially from the first arcuate deflector. The method further includes the step of directing 510 a second portion of the gas flow, with the at least one second arcuate deflector, through a remainder segment of the expanding spiral revolution.

The foregoing detailed description describes the present invention with reference to specific representative embodiments. It will be appreciated, however, that various modifications and changes can be made without departing from the scope of the invention as set forth in the appended claims. Consequently, the detailed description and accompanying drawings are to be regarded as illustrative, rather than restrictive, and any such modifications or changes are intended to fall within the scope of the invention as described and set forth herein.

More specifically, while illustrative representative embodiments of the present invention have been described herein, the invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

What is claimed and desired to be secured by Letters Patent is:

1. A muffler for attenuating acoustic noise in a gas flow, comprising:

a casing having an inlet and an outlet, wherein a gas flow passes through the casing from the inlet to the outlet; and an acoustic trap disposed within the casing and spanning a distance between opposing top and bottom walls of the casing, the acoustic trap comprising:

a first arcuate deflector having a concave frontside configured to direct the gas flow from the inlet through a first segment of an expanding spiral revolution; and at least one second arcuate deflector radially offset from the first arcuate deflector and configured to direct a portion of the gas flow through a remainder segment of the expanding spiral revolution.

2. The muffler of claim 1, wherein the at least one second arcuate deflector is spirally concentric about the center axis with the first arcuate deflector.

3. The muffler of claim 1, wherein a leading end of the at least one second arcuate deflector overlaps a trailing end of the first arcuate deflector.

4. The muffler of claim 1, further comprising an inlet stub extending from the inlet and penetrating through the first arcuate deflector.

5. The muffler of claim 1, wherein the at least one second arcuate deflector is radially offset outwardly from the first arcuate deflector to allow a first portion of the gas flow to pass through a radial gap between the first arcuate deflector and the second arcuate deflector.

6. The muffler of claim 5, further comprising a second portion of the gas flow being directed by the at least one second arcuate deflector about a convex backside of the first arcuate deflector prior to exiting the outlet.

7. The muffler of claim 1, wherein the first arcuate deflector directs a gas flow vector from zero degrees relative to the inlet gas flow to between about one hundred ten degrees to about one hundred seventy degrees relative to the inlet gas flow.

8. The muffler of claim 1, wherein the at least one second arcuate deflector further comprises a plurality of apertures formed along the length thereof for allowing a portion of the gas flow to exit the acoustic trap therethrough.

9. The muffler of claim 1, wherein the least one second arcuate deflector further comprises a second and at least one third arcuate deflector, and wherein the third arcuate deflector is radially offset from the second arcuate deflector.

10. The muffler of claim 9, wherein the third arcuate deflector is radially offset inwardly from the second arcuate deflector.

11. The muffler of claim 9, wherein a part of the second portion of the gas flow passes through a radial gap between the second deflector and the at least one third deflector.

12. The muffler of claim 9, wherein the second arcuate deflector directs a gas flow vector from between about one hundred degrees to about one hundred sixty degrees relative to the inlet gas flow to about two hundred twenty degrees relative to the inlet gas flow.

13. The muffler of claim 9, wherein the third arcuate deflector directs a gas flow vector from about two hundred degrees relative to the inlet gas flow to about two hundred seventy degrees relative to the inlet gas flow.

14. The muffler of claim 9, wherein the at least one third arcuate deflector comprises a plurality of arcuate deflectors having leading ends positioned around the remainder segment of the expanding spiral revolution and trailing ends directed towards a perimeter of the casing.

15. The muffler of claim 1, wherein the at least one second arcuate deflector is radially offset inwardly from the first arcuate deflector and a first portion of the gas flow passes through a radial gap between the first arcuate deflector and the second arcuate deflector and into at least one additional acoustic trap arranged in series with the acoustic trap.

16. The muffler of claim 15, wherein the at least one additional acoustic trap comprises a large arcuate deflector opposite from a small arcuate deflector and together positioned to form a gas vortex rotating in a direction opposite a direction of rotation of the expanding spiral revolution.

17. The muffler of claim 15, wherein the at least one additional acoustic trap comprises a plurality of additional acoustic traps, each having a large arcuate deflector opposite from small arcuate deflector and together positioned to form a gas vortex rotating in a direction opposite a direction of rotation of the rotating gas vortex in the preceding acoustic trap.

18. A muffler for attenuating acoustic noise in a gas flow, comprising:

a casing having an inlet and an outlet, wherein a gas flow passes through the casing from the inlet to the outlet;

an inlet stub having a proximal end fluidly coupled to the inlet and a distal end penetrating an acoustic trap disposed within the casing and spanning a distance between opposing top and bottom walls of the casing; and the acoustic trap comprising:

a first arcuate deflector having a concave surface for receiving and directing the gas flow from the inlet stub through a first segment of an expanding spiral revolution; and at least one second arcuate deflector radially offset outwardly from the first arcuate deflector for directing a majority portion of the gas flow through a remainder segment of the expanding spiral revolution.

19. The muffler of claim 18, wherein the at least one second arcuate deflector directs the portion of the gas flow around the inlet stub and behind a outer convex surface of the first arcuate deflector prior to exiting the outlet.

20. A muffler for attenuating acoustic noise in a gas flow, comprising:

a casing having an inlet and an outlet, wherein a gas flow passes through the casing from the inlet to the outlet;

an inlet stub having a proximal end fluidly coupled to the inlet and a distal end penetrating an acoustic trap disposed within the casing and spanning a distance between opposing top and bottom walls of the casing;

the acoustic trap comprising:

a first arcuate deflector having a concave surface for receiving and directing the gas flow from the inlet stub through a first segment of an expanding spiral revolution; and at least one second arcuate deflector radially offset inwardly from the first arcuate deflector for directing a minority portion of the gas flow through a remainder segment of the expanding spiral revolution, prior to exiting the outlet; and at least one additional acoustic trap arranged in series with the acoustic trap and receiving a majority portion of the gas flow through a radial gap between the first arcuate deflector and the second arcuate deflector, and configured to form a gas vortex rotating in a direction opposite the expanding spiral revolution.

21. A method of attenuating acoustic noise in a gas flow, comprising:

providing an inlet gas flow containing acoustic noise to a casing having an inlet and an outlet;

receiving the inlet gas flow directly into an acoustic trap enclosed within the casing and spanning a distance between opposing top and bottom walls of the casing;

directing the gas flow through a first segment of an expanding spiral revolution with a first arcuate deflector;

bleeding off a first portion of the gas flow through a gap formed between the first arcuate deflector and at least one second arcuate deflector offset radially from the first arcuate deflector; and directing a second portion of the gas flow through a remainder segment of the expanding spiral revolution with the at least one second arcuate deflector.

22. The method of claim 21, wherein bleeding off the first portion of the gas flow comprises redirecting the first portion in a reverse direction with the second arcuate deflector being offset outwardly from the first arcuate deflector.

23. The method of claim 21, wherein bleeding off the first portion of the gas flow comprises redirecting the first portion into at least one additional acoustic trap arranged in series with the acoustic trap and having a large arcuate deflector opposite and concentric with a small arcuate deflector, the large and small arcuate deflector being positioned together to form a gas vortex rotating in a direction opposite the expanding spiral revolution.

24. A muffler for attenuating acoustic noise in a gas flow, comprising:

a casing having an inlet and an outlet, wherein a gas flow passes through the casing from the inlet to the outlet;

a primary acoustic trap spanning a distance between opposing top and bottom walls of the casing that receives and directs the entire inlet gas flow through a first segment of an expanding spiral revolution; and at least one secondary acoustic trap arranged in series with the primary acoustic trap that receives and directs a first portion of the inlet gas flow into a gas vortex rotating in a direction opposite a direction of rotation of the expanding spiral revolution prior to exiting the outlet, wherein a remainder portion of the inlet gas flow is directed through a remainder segment of the expanding spiral revolution and about an outside of the first and at least one second acoustic traps, prior to exiting the outlet.

25. The muffler of claim 24, wherein the at least one secondary acoustic trap comprises a plurality of secondary acoustic traps that each receive and direct a diminishing portion of the inlet gas flow into a gas vortex rotating in a direction opposite a direction of rotation of the rotating gas vortex in the preceding acoustic trap.

* * * * *